United States Patent [19]

Terao et al.

[11] 4,307,319

[45] Dec. 22, 1981

[54] SEMICONDUCTOR LAYER OF OXYGEN DEPLETION TYPE CERIUM OXIDE OR LEAD OXIDE

[75] Inventors: Motoyasu Terao, Tokyo; Tadaaki Hirai, Koganei; Eiichi Maruyama, Kodaira; Hideaki Yamamoto, Hachioji; Tsutomu Fujita, Mobara; Naohiro Goto, Machida; Keiichi Shidara, Tama, all of Japan

[73] Assignees: Hitachi, Ltd.; Nippon Hoso Kyokai, both of Tokyo, Japan

[21] Appl. No.: 921,948

[22] Filed: Jul. 5, 1978

Related U.S. Application Data

[63] Continuation-in-part of Ser. No. 727,691, Sep. 28, 1976.

[30] Foreign Application Priority Data

Oct. 3, 1975 [JP] Japan ..... 50-119633

[51] Int. Cl.[3] ..... H01J 29/45

[52] U.S. Cl. ..... 313/386

[58] Field of Search ..... 313/385, 386, 384

[56] References Cited

U.S. PATENT DOCUMENTS

| | | | |
|---|---|---|---|
| 3,346,755 | 10/1967 | Dresner | 313/386 X |
| 3,350,595 | 10/1967 | Kramer | 313/386 |
| 3,396,053 | 8/1968 | Tojo | 313/386 X |
| 3,405,298 | 10/1968 | Dresner | 313/385 |

FOREIGN PATENT DOCUMENTS 44-24223 of 1969 Japan .

*Primary Examiner*—Robert Segal

*Attorney, Agent, or Firm*—Craig and Antonelli

[57] ABSTRACT

A photoelectric device comprises a signal electrode, a layer of amorphous photoconductor containing 50 atomic percent or more of selenium and an N-type semiconductor layer made of a material selected from the group consisting of oxygen depletion type cerium oxide and oxygen depletion type lead oxide and disposed therebetween, which has a thickness greater than 8 nm and up to and including 500 nm and a Fermi level located within an energy range of 0.2 to 0.8 eV from the bottom of a conduction band.

5 Claims, 7 Drawing Figures

SEMICONDUCTOR LAYER OF OXYGEN DEPLETION TYPE CERIUM OXIDE OR LEAD OXIDE

CROSS-REFERENCE TO RELATED APPLICATION

This application is a continuation-in-part application of U.S. Ser. No. 727,691, filed on Sept. 28, 1976.

The present invention relates to a photoelectric device having a photoconductive layer such as a target of a photoconductive image pickup tube.

A photoconductive image pickup tube having a photoconductive layer, which is a typical example of a photoelectric device, generally comprises a light-transmitting substrate, a signal electrode disposed thereon and a photoconductive layer which is scanned by an electron beam emitted from a cathode. In a normal operation of this type of image pickup tube, the signal electrode is positively biased with respect to the cathode and an electric field is applied to the photoconductive layer in such a polarity that the signal electrode is positive while the scanning electron beam is negative. Thus, a dark current flowing into the target may be classified into two categories, one due to a hole current injected from the signal electrode to the photoconductive layer and the other due to an electron current injected from the scanning electron beam to the photoconductive layer.

In an image pickup tube target which uses a photoconductor exhibiting a usual P-type conduction such as a selenium-based amorphous photoconductor, it is relatively easy to suppress the injection of the electrons from the scanning electron beam in order to suppress the dark current because a mobility of the electrons is small, but it is relatively difficult to suppress the injection of the holes from the signal electrode. This is particularly difficult where a film structure having a high sensitivity in which a strong electric field is established near an interface between the signal electrode and the photoconductor, is used.

Various methods have been heretofore proposed to suppress the dark current of the target of the photoconductive image pickup tube of the type described above. Among others, it has been proposed to interpose a layer of a different kind of material between the signal electrode and the amorphous photoconductor layer. Some of the proposed methods may be effective to the suppression of the dark current but, in practice, they include various inconveniences when considered from the entire operation of the image pickup tube. Particularly, a method of interposing pure selenium as disclosed in the U.S. Pat. No. 3,405,298 has a drawback that white defects are created in a pickup image because of locallized reduction of resistance due to crystallization of the pure selenium. A method of interposing an insulating film as disclosed in the Japanese Patent Publication No. 24223/69 also has a drawback in that a drift in a signal current frequently occurs because the insulating film impedes not only the passage of the dark current but also the passage of the signal current. In the U.S. Pat. No. 3,350,595 it was disclosed that a stronger blocking effect can be obtained by interposing a layer of cesium or cerium having a thickness ranging from 1 to 5 nm between the photoconductive layer and the signal electrode, which layer is at least partly converted to oxide and/or selenide during the processing. However, according to experiments of inventors of the present invention, the effect of this layer for suppressing the dark current is not satisfactory.

It is an object of the present invention to provide a photoelectric device which overcomes the above drawbacks and operates in a stable manner while effectively suppressing the dark current.

The above object is accomplished by the photoelectric device of the present invention which comprises a signal electrode and an amorphous photoconductor layer containing 50 atomic % or more of selenium, and further comprises an N-type semiconductor layer made of a material selected from the group consisting of oxygen depletion type cerium oxide and oxygen depletion type lead oxide and disposed therebetween, which has a thickness greater than 8 nm and up to and including 500 nm and a Fermi level located within an energy range of 0.2 and 0.8 eV from the bottom of a conduction band.

The present invention will now be described in detail in conjunction with the preferred embodiments thereof illustrated in the accompanying drawings. It should be understood, however, that various changes and modifications may be made without departing from the spirit of the present invention.

Figure 1:
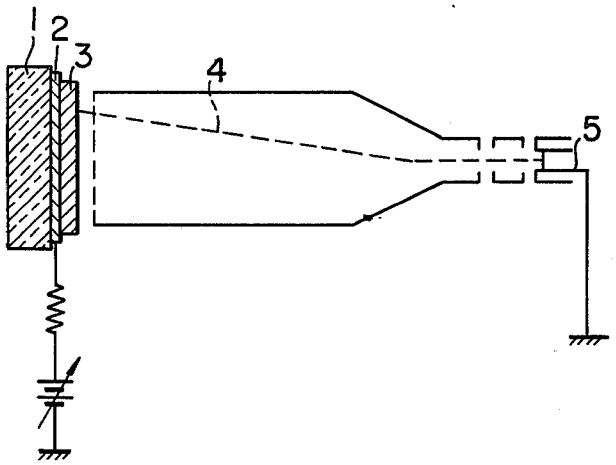
FIG. 1 illustrates a principle of the operation of an image pickup tube.

Referring to FIG. 1, the principle of the photoconductive image pickup tube is illustrated, in which 1 designates a light-transmitting substrate, 2 a signal electrode, 3 a photoconductor layer, 4 a scanning electron beam, and 5 a cathode.

Figure 2:
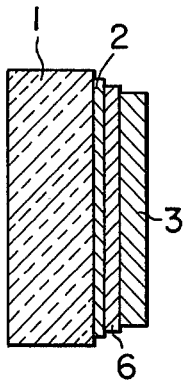
FIG. 2 shows a structure of a target of the image pickup tube according to a photoelectric device of the present invention.

FIG. 2 shows a structure of a target of the image pickup tube embodying the present invention, in which 1 designates the light-transmitting substrate, 2 the light-transmitting signal electrode, 3 the P-type photoconductor layer and 6 an N-type semiconductor layer.

In order to prevent the injection of the holes from the signal electrode 2 to the photoconductor layer 3 while permitting the flow of the electrons created in the photoconductor layer 3 into the signal electrode 2 without prevention, it is desired for the N-type semiconductor layer 6 disposed between the signal electrode 2 and the photoconductor layer 3 to meet the following requirements. Namely, in order for the N-type semiconductor layer 6 to effectively prevent the injection of the holes from the signal electrode 2 to the photoconductive layer 3, it is necessary that the energy difference between a Fermi level $E_F$ of the N-type semiconductor and the top of the valence band thereof is larger than that of the photoconductor. It is desirable that the difference between the two materials be as large as possible. When the above requirements are met, the holes generated in the signal electrode are prevented from being injected into the photoconductor for creating the dark current.

The inventors of the present invention have also found that in order to prevent the recombination of carriers generated in the photoconductor layer by light of a short wavelength to maintain a high sensitivity, it was effective to utilize a window effect of the N-type semiconductor layer 6, and that for this purpose it was desirable that the width of the forbidden band of the N-type semiconductor was larger than that of the photoconductor layer.

Figure 3:
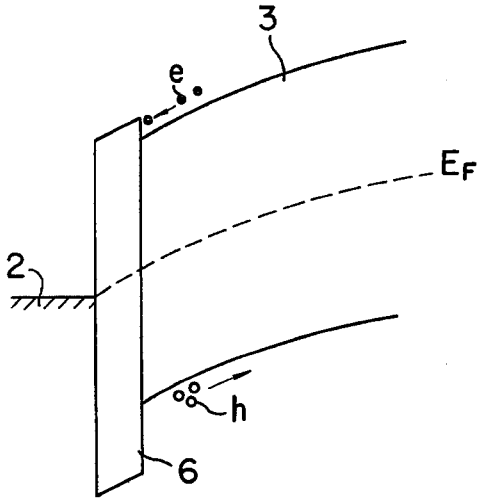
FIGS. 3 and 4 are diagrams showing band structures for explaining the principle of the present invention.
Figure 4:
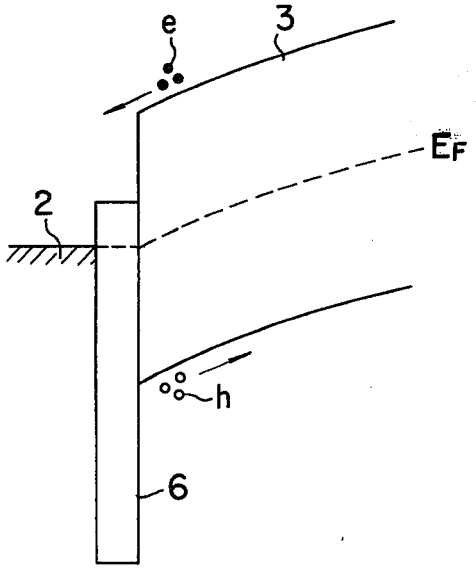

On the other hand, where the energy difference between the Fermi level of the N-type semiconductor and the bottom of the conduction band thereof is too large, there occurs a barrier between the conduction band of the photoconductor layer 3 and the conduction band of the N-type semiconductor layer 6, as shown in FIG. 3, which barrier blocks the flow of the electrons and around which the electrons are trapped to create space charges which in turn cause a drift in a steady photoelectric current. In FIGS. 3 and 4 e and h represent electrons and holes, respectively. Accordingly, the energy difference between the Fermi level and the bottom of the conduction band of the N-type semiconductor should be smaller than that of the photoconductor.

While the N-type semiconductor layer 6 is shown to be interposed between the photoconductor layer 3 and the signal electrode 2, the N-type semiconductor layer 6 need not necessarily be contiguous to the signal electrode 2 but a further layer of different material may be interposed between the signal electrode 2 and the N-type semiconductor layer 6. It is desirable, on the other hand, that the photoconductor layer 3 and the N-type semiconductor layer 6 be contiguous to each other, because if holes were generated in an interposed layer between the photoconductor layer and the N-type semiconductor layer or near an interface between the interposed layer and the photoconductor layer, the N-type semiconductor layer could not prevent the injection of the holes into the photoconductor layer.

For example, a selenium-based amorphous photoconductor layer such as that containing 50 atomic % or more of selenium has a width of the forbidden band of about 2.0 eV and normally exhibits P-type conduction because the mobility of the holes is larger than the mobility of the electrons. However, since the activation energy of the conductivity thermally measured is approximately equal to one half of the width of the forbidden band optically measured, it is considered that the Fermi level is around the center of the forbidden band. Thus, the energy difference between the Fermi level and the top of the valence band is about 1 eV, and the energy level between the Fermi level and the bottom of the conduction band is also about 1 eV.

Accordingly, the N-type semiconductor which is suitable to use in combination with the amorphous photoconductor containing 50 atomic % or more of selenium should have the width of the forbidden band of 2 eV or more, the energy difference between the Fermi level and the top of the valence band of 1 eV or more, and the energy difference between the Fermi level and the bottom of the conduction band of 1 eV or less.

When the energy difference between the Fermi level and the bottom of the conduction band in the N-type semiconductor is 1 eV or less, the free flow of the electrons is not impeded. It has been experimentally proven that an N-type semiconductor having the above energy difference in a range of 0.2 to 0.8 eV presented a particularly good result.

The energy difference between the Fermi level and the bottom of the conduction band was measured in the following manner. A pair of metal electrodes each 10 mm square and about 80 nm in thickness were formed on a clean $SiO_2$ glass substrate. One of four sides of each of the metal electrodes was spaced from each other by about 0.05 mm. An N-type semiconductor layer of about 40 nm thickness was vapor deposited over the electrode to cover the gap therebetween. The electric resistance between the electrodes was measured at various temperatures to determine the activation energy of the resistance R, that is, $\Delta E$ in the expression of $R=R_o \exp(-\Delta E/kT)$, where $R_o$ is a constant, k Boltzmann's constant, and T absolute temperature. It is considered that the activation energy approximately equals the energy difference between the Fermi level and the bottom of the conduction band of the N-type semiconductor.

The electric resistance of the N-type semiconductor made of an oxide is closely related to the magnitude of the activation energy. In this type of the N-type semiconductor, an oxygen deficiency in the oxide establishes a donor level near the bottom of the conduction band. The higher the concentration of this level, the lower becomes the resistance and the smaller becomes the energy difference between the Fermi level and the bottom of the conduction band. On the other hand, there is a preferable range of resistivity for the resistivity of the N-type semiconductor. If the resistivity of the N-type semiconductor is much higher than the resistivity of the photoconductor, most of the voltage is applied across the N-type semiconductor layer resulting in the breakage of the N-type semiconductor. If the resistivity of the N-type semiconductor is too low, electron injection from the N-type semiconductor to the electrode occurs. Accordingly, a preferable energy difference between the Fermi level and the bottom of the conduction band is in the range of about 0.2 to 0.8 eV.

Not only when the photoconductor layer exhibits the P-type conduction but also when it exhibits the N-type or intrinsic conduction, the hetero-junction with the N-type semiconductor layer is effective to prevent the hole injection and to generate photo-e.m.f.

Figure 5:
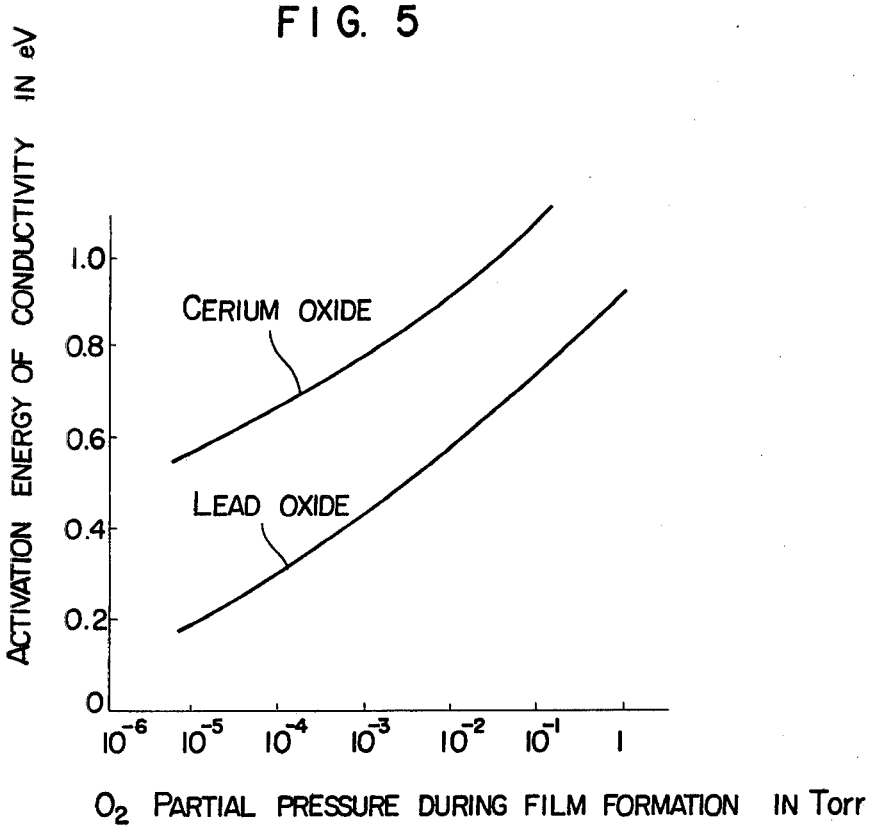
FIG. 5 illustrates a relation of an oxygen partial pressure during the formation of the N-type semiconductor of the present invention relative to activation energy of the conductivity.
Figure 6:
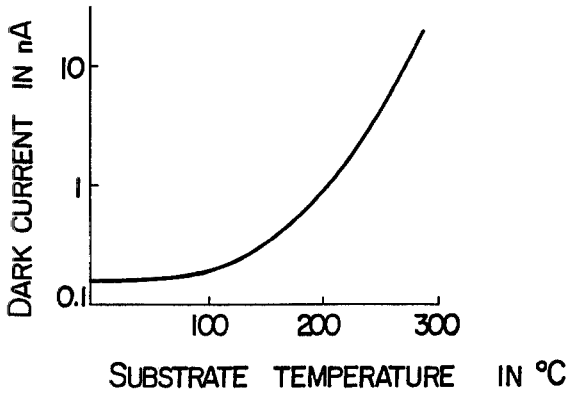
FIG. 6 illustrates a relation between the substrate temperature during deposition by evaporation and the dark current for a film thickness of 40 nm.

One example of the N-type semiconductor which has a relatively large width of the forbidden band of 2 eV or more and the Fermi level of which near a room temperature can be readily controlled is reduction type (oxygen depletion type) metal oxides. Among them, cerium oxide and lead oxide have the width of the forbidden band of 2 eV or more and they can be converted into N-type semiconductors having the Fermi levels in the range of 0.2 to 0.8 eV from the bottom of the conduction bands, through vacuum deposition or sputtering deposition under a certain working condition. For cerium oxide, the above N-type semiconductor can be formed by a normal vacuum deposition without any gas introduction and any intentional heating of the substrate. From FIG. 5 which shows the relation between the oxygen partial pressure of the atmosphere and the activation energy of the conductivity in the vacuum deposition employing the oxide itself as an evaporation source, it is seen that appropriate oxygen partial pressure during the formation of the film is $1\times10^{-3}$ Torr or lower for the cerium oxide and $1\times10^{-1}$ Torr or lower for the lead oxide. The substrate temperature during the formation of the film is preferably between 50° and 200° C. (In FIG. 5, the substrate temperature was set at 100° C.). It has been experimentally provided that the possibility of the occurrence of white defects in the pickup image was lower and the dark current was lower when the substrate temperature was set between 50° and 200° C. FIG. 6 shows a dark current when a film thickness of 40 nm was formed under the above condition. With the film formed by evaporating the cerium oxide at the substrate temperature of about 200° C., spots were clearly observed in an electron diffraction pattern, but with the film formed by evaporating the cerium oxide at lower substrate temperatures, only ring-shaped patterns were observed and the film was nearly amorphous. Where the substrate temperature is set at a temperature between 50° and 200° C., the adhesion of the N-type semiconductor layer is improved preventing the occurrence of defects due to local separations of the N-type semiconductor layer from the electrode on the substrate surface. Good results can be obtained at deposition rates between 0.1 and 1 nm/sec.

As stated before, it is desirable that the width of the forbidden band of the N-type semiconductor layer be greater than 2 eV. Moreover, the N-type semiconductor layer should exhibit high chemical stability and should be hard to react with the signal electrode and the photoconductor layer. Among numerous substances which meet the above requirements, oxygen depletion type cerium oxide and oxygen depletion type lead oxide give particularly satisfactory results. Probably, this is because they have a relatively smaller number of localized states as compared with CdS, CdSe, $Bi_2O_3$ and $SnO_2$.

Figure 7:
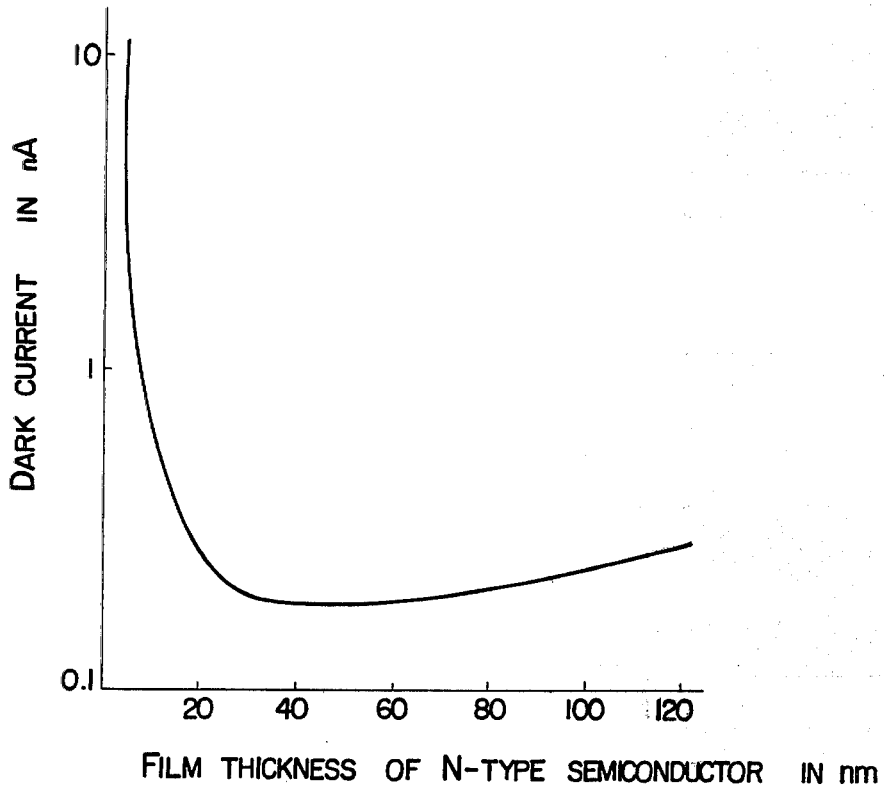
FIG. 7 illustrates a relation between the film thickness of the N-type semiconductor of the present invention and the dark current.

From FIG. 7 illustrating the relation of the film thickness and the dark current, it is seen that the thickness of the N-type semiconductor layer 6 is preferably more than 8 nm at which the dark current decreases below 1 nA. For an image pickup tube having a p-n junction between a P-type selenium-based photoconductive layer and an N-type semiconductive layer, if the tube has a dark current greater than 1 nA, the dark current will further increase during a continuous operation over one hour. As a result, there will be observed after-image or lag and hence any initially good picture will not be obtained after a long operation. Therefore, it is very important to have an initial dark current less than 1 nA. Increase of the dark current results also in the deterioration of the thermal stability of the photoconductor layer 3. Where the oxide is used as the N-type semiconductor, it is very difficult, with a method of oxidizing the metal after the evaporation thereof, to cause the film of the above thickness to have a desired band structure at any portion along the direction of the thickness, and the optical transmissivity tends to reduce. It is, therefore, appropriate to form the film by a method of vacuum deposition using the oxide itself as the evaporation source. On the other hand, if the film thickness exceeds 500 nm, the optical transmissivity is reduced and cracks will be produced due to the difference in thermal expansion coefficients of the film and the substrate 1. It is, therefore, desirable that the film thickness is 500 nm or below. A more preferable range of the film thickness is between 12 nm and 150 nm.

EXAMPLE 1

A transparent tin oxide electrode is formed on a glass substrate, and while maintaining the substrate at 150° C., a film of lead oxide is vacuum deposited to a thickness of 20 nm using a platinum boat in an oxygen atmosphere of $5\times10^{-3}$ Torr. An amorphous photoconductor layer consisting of 80 atomic % of selenium, 10 atomic % of arsenic and 10 atomic % of tellurium is vacuum deposited thereon to a thickness of 4 μm, and an antimony trisulfide layer is further vacuum deposited thereon to a thickness of 100 nm in a vacuum of $1\times10^{-2}$ Torr to prevent the emission of secondary electrons. In this manner, a target of a vidicon type image pickup tube is completed. A dark current of the present image pickup tube is 0.2 nA at a target voltage of 50 volts.

EXAMPLE 2

A transparent indium oxide electrode is formed on a glass substrate, and while maintaining the glass substrate at 100° C., cerium oxide is vacuum deposited thereon to a thickness of 10 nm using a molybdenum boat in a vacuum of $1\times10^{-6}$ Torr. An amorphous photoconductor consisting of 95 atomic % of selenium, 4 atomic % of arsenic and 1 atomic % of tellurium is vacuum deposited thereon to a thickness of 5 μm in the vacuum of $1\times10^{-6}$ Torr, and an antimony trisulfide layer is further vacuum deposited thereon to a thickness of 100 nm in a vacuum of $5\times10^{-2}$ Torr to prevent the emission of secondary electrons. In this manner, a target of the vidicon type image pickup tube is completed. A dark current of the present image pickup tube is 0.3 nA at a target voltage of 60 volts.

EXAMPLE 3

Figure 8:
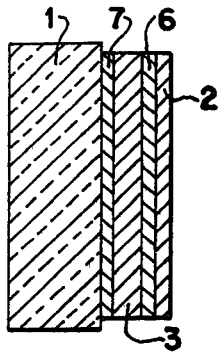
FIG. 8 illustrates another embodiment of this invention.

FIG. 8 shows another embodiment of this invention.

A gold electrode 7 is deposited on a glass substrate 1, and an amorphous photoconductor 3 consisting of 70 atomic % of selenium, 15 atomic % of arsenic and 15 atomic % of tellurium is vacuum deposited thereon to a thickness of 2 μm, cerium oxide 6 is vacuum deposited thereon to a thickness of 20 nm in a vacuum of $1\times10^{-6}$ Torr at a substrate temperature of 10° C. using a molybdenum boat, and a translucent aluminum film 2 acting as a signal electrode is further deposited thereon. The assembly is used as a solid state photosensitive device in which light is incident upon the aluminum electrode 2. A dark current of the present photosensitive device is 0.5 nA at an applied voltage of 20 volts. A one-dimension photoelectric image pickup device can be constructed by dividing the aluminum electrode into stripes.

The striped aluminum electrodes are connected to a circuit which sequentially reads stored charges by means of external switches.

It is apparent from the above examples that the present invention, when applied to the image pickup tube target or the solid state photosensitive device, can suppress the dark current without adversely effecting the signal current and hence it is very effective in enhancing the stability of the operation of the device.

The dark current can be generally reduced by about one order of magnitude although it varies depending on the kind of the photoconductors used. For example, for Se-As-Te photoconductor, a dark current which would otherwise exist in a range of 2–5 nA can be reduced to 0.2–0.5 nA.

We claim:

1. A photoelectric device comprising a signal electrode, and N-type semiconductor layer disposed adjacent said signal electrode, said semiconductor layer having a thickness greater than 8 nm and up to and including 500 nm and a Fermi level located within an energy range of 0.2 to 0.8 eV from the bottom of a conduction band and being made of a material selected from the group consisting of oxygen depletion type cerium oxide and oxygen depletion type lead oxide, and an amorphous photoconductor layer containing 50 atomic % or more of selenium disposed adjacent said N-type semiconductor layer.

2. A photoelectric device according to claim 1, wherein the thickness of said N-type semiconductor layer is 12 nm to 150 nm.

3. A photoelectric device according to claim 1, further comprising a light-transmitting substrate, on which said signal electrode is disposed, the surface of said substrate, which is opposite to said signal electrode, constituting a light receiving surface.

4. A photoelectric device comprising a signal electrode, an N-type semiconductor layer disposed adjacent said signal electrode, said semiconductor layer having a thickness greater than 8 nm and up to and including 500 nm and a Fermi level located within an energy range of 0.2 to 0.8 eV from the bottom of a conduction band and being made of a material selected from the group consisting of oxygen depletion type cerium oxide and oxygen depletion type lead oxide, and an amorphous photoconductor layer containing 50 atomic % or more of selenium disposed adjacent said N-type semiconductor layer, and further comprising another electrode adjacent said amorphous photoconductor layer, said amorphous layer being sandwiched between said N-type semiconductor layer and said another electrode, and wherein an incident light ray is adapted to fall on said signal electrode.

5. A photoelectric device according to claim 1, wherein the N-type semiconductor layer has a width of the forbidden band of at least 2 eV, and an energy difference between the Fermi level and the top of the valence band of at least 1 eV.

* * * * *